US007921924B2

(12) United States Patent
Xu et al.

(10) Patent No.: US 7,921,924 B2
(45) Date of Patent: Apr. 12, 2011

(54) SYSTEM AND METHOD FOR CONTROLLING ACTUATION OF A WELL COMPONENT

(75) Inventors: Zheng R. Xu, Sugar Land, TX (US); William D. Eatwell, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 357 days.

(21) Appl. No.: 11/610,777

(22) Filed: Dec. 14, 2006

(65) Prior Publication Data

US 2008/0142223 A1 Jun. 19, 2008

(51) Int. Cl.
*E21B 23/00* (2006.01)

(52) U.S. Cl. ..... 166/381; 166/55; 166/298

(58) Field of Classification Search ..... 166/298, 166/55, 376, 381, 383
See application file for complete search history.

(56) References Cited

U.S. PATENT DOCUMENTS

| | | | | |
|---|---|---|---|---|
| 4,796,705 | A * | 1/1989 | Carmody et al. | 166/323 |
| 5,351,791 | A | 10/1994 | Rosenzweig | |
| 5,718,288 | A | 2/1998 | Bertet et al. | |
| 6,371,203 | B2 * | 4/2002 | Frank et al. | 166/207 |
| 6,691,777 | B2 * | 2/2004 | Murray et al. | 166/216 |
| 2005/0150660 | A1 * | 7/2005 | Cook et al. | 166/380 |
| 2005/0199401 | A1 * | 9/2005 | Patel et al. | 166/387 |
| 2008/0000646 | A1 * | 1/2008 | Thomson | 166/387 |

FOREIGN PATENT DOCUMENTS

| | | | |
|---|---|---|---|
| GB | 2414496 | A | 11/2005 |
| WO | 02059456 | A1 | 8/2002 |

* cited by examiner

*Primary Examiner* — Daniel P Stephenson
*Assistant Examiner* — Brad Harcourt
(74) *Attorney, Agent, or Firm* — Michael L. Flynn; David Hofman; Robin Nava

(57) ABSTRACT

A technique is provided for controlling actuation of a well component. A resistance device is deployed in a tool string and connected to a well tool to be actuated. The resistance device comprises a deformable body and a deforming member that move relative to one another during actuation of the well tool. Deformation of the deforming member provides constant resistance and consequent control over component actuation.

23 Claims, 6 Drawing Sheets

SYSTEM AND METHOD FOR CONTROLLING ACTUATION OF A WELL COMPONENT

BACKGROUND

A variety of well devices are actuated at downhole locations. For example, packers, release subs, shock absorbers, and many other types of well tools are actuated while positioned in the wellbore. The actuation is accomplished by generating a force that acts on the well tool in a predetermined manner to transition the well tool from one state to another. The actuation force can be generated mechanically, hydraulically, or by other suitable energy sources. However, insufficient control over the actuating force can cause the well tool to be transitioned at an undesirable rate or in an undesirable manner.

SUMMARY

In general, the present invention provides a system and method for controlling actuation of well components. Control is achieved by providing a constant resistance during actuation of the well tool. A resistance device is deployed in a tool string and connected to the subject well tool. The resistance device comprises a deformable body coupled with a deforming member that moves relative to the deformable body during actuation of the well tool. Resultant deformation provides the constant resistance and the consequent control over component actuation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for facilitating the controlled actuation of a well component. The system and methodology enable the use of a resistance during actuation of a well component to improve transition of the well component from one state to another. Generally, a resistance device is connected within a well tool string and coupled to at least one well component able to undergo an actuation. The energy for actuation can be supplied mechanically, hydraulically, or by other suitable methods able to create a sufficient force to move a component or components of the well tool over a required distance for actuation. The resistance device is engaged to provide resistance to the actuating movement, thus controlling and improving component actuation in many applications. In a well application, the well tool string and resistance device are moved into a wellbore to a specific location as desired for carrying out the well operation.

Generally, the resistance device comprises a deformable body that is deformed in a controllable sequential manner. This localized deformation requires application of a constant force over a distance, thus requiring constant continuous work. Resistance devices can be designed, for example, to provide a constant crush resistance, an axial load, or impact energy absorption over a certain deformation length of the deformable body. This controlled resistance can be used with a variety of downhole well tools to improve tool functionality.

Figure 1:
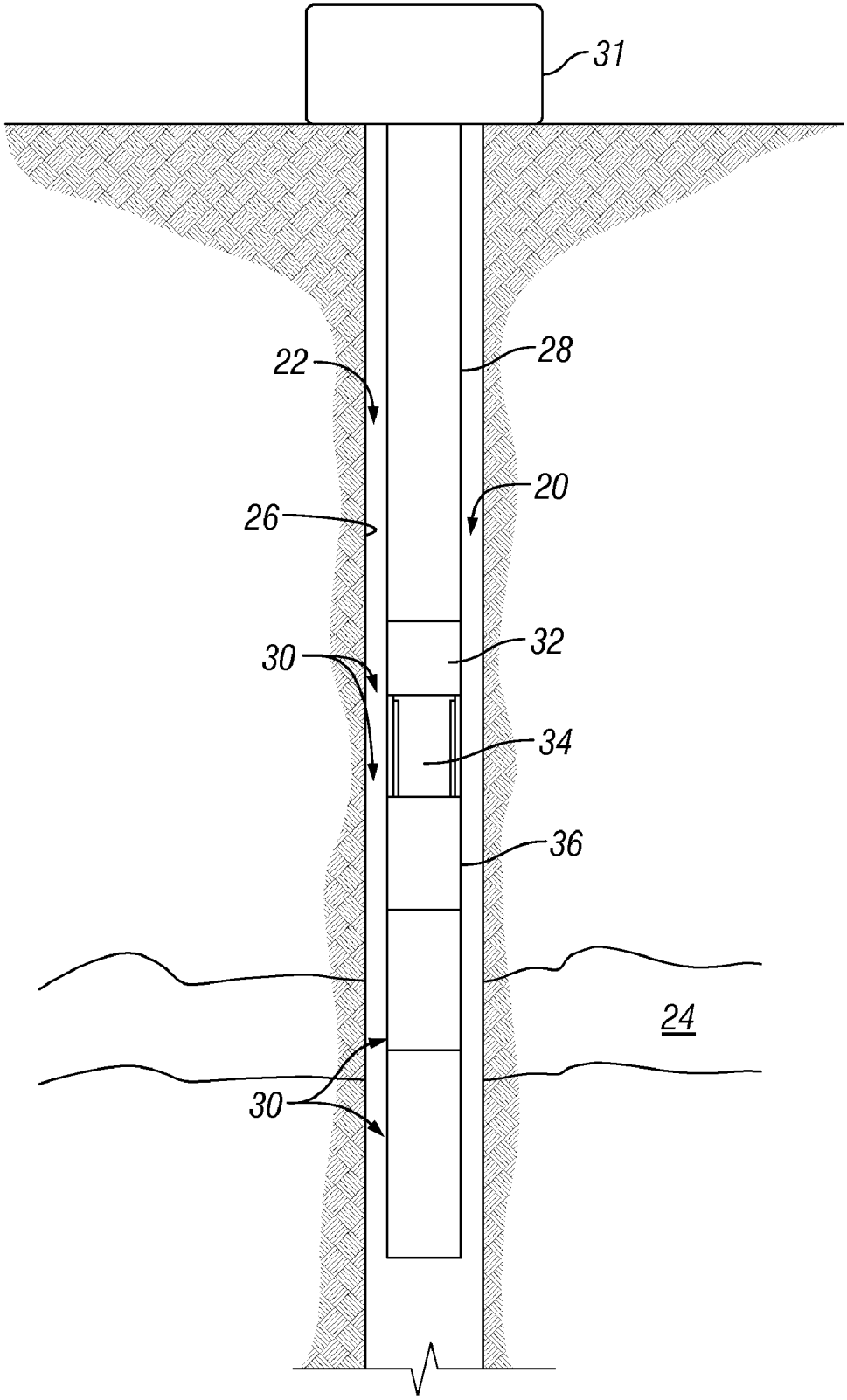
FIG. 1 is an elevation view of a tool string deployed in a wellbore and having an actuation control/resistance device, according to an embodiment of the present invention.

Referring generally to FIG. 1, one embodiment of a well tool string 20 is illustrated as deployed in a wellbore 22 that extends into, for example, a desired formation 24. In many applications, wellbore 22 is lined with an appropriate liner or well casing 26. A deployment system 28, such as coiled tubing, is used to move a well completion or other well tools 30 downhole. Depending on the specific well application, the type of well tools, the number of well tools, and the arrangement of well tools in well tool string 20 may vary.

In the embodiment illustrated, deployment system 28 extends downwardly from a wellhead 31 and is coupled to a connector 32 used to connect the deployment system to a variety of other components. For example, well tool string 20 comprises an actuatable well tool 34 that may be selectively actuated while at a downhole position in wellbore 22. Well tool 34 is coupled to an actuation control device, i.e. a resistance device, 36 in a manner that provides controlled resistance to actuation of well tool 34. Additionally, well tool string 20 may comprise various other well tools 30 selected as desired for a specific well operation, e.g. a production operation and/or a well servicing operation. Depending on the type of well operation, resistance device 36 can be used with many types of actuatable well tools 34. For example, well tool 34 may comprise an inflatable packer, a controlled release sub, an energy absorber, e.g. shock absorber, or other well tools designed for actuation from one state to another while downhole.

In many applications, resistance device 36 comprises a deformable body that cooperates with a deforming member. As well tool 34 is actuated, relative movement occurs between the deforming member and the deformable body to deform the deformable body and thereby provide resistance to the actuating movement. Also, resistance device 36 can be designed to provide a relatively constant resistance which can be achieved by pre-work hardening the deformable body.

Figure 2:
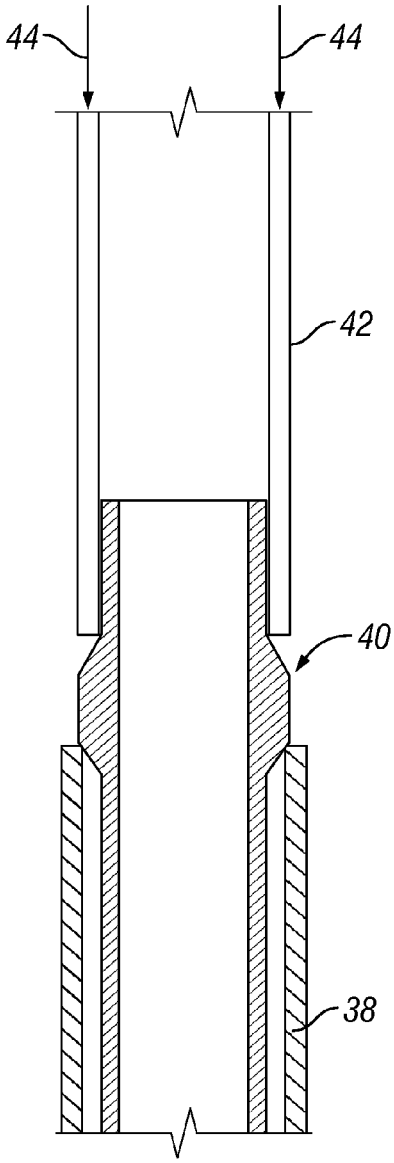
FIG. 2 is a cross-sectional view of an embodiment of the actuation control device prior to pre-work hardening, according to an embodiment of the present invention.
Figure 3:
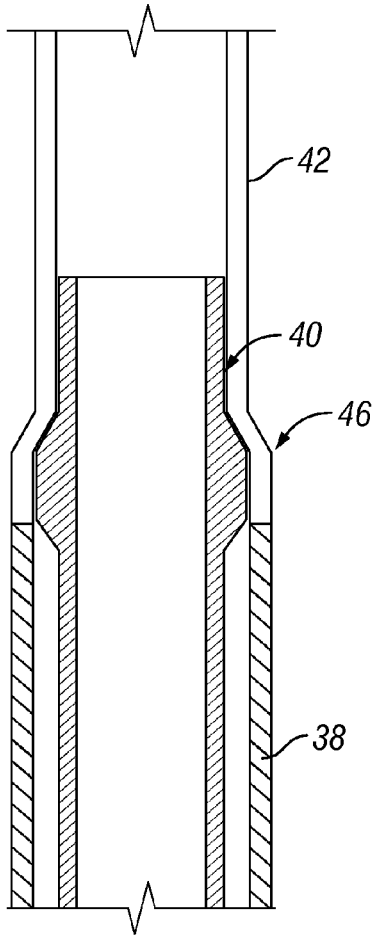
FIG. 3 is a cross-sectional view of the embodiment illustrated in FIG. 2 following pre-work hardening, according to an embodiment of the present invention.

One example of pre-work hardening the deformable body is explained with reference to FIGS. 2 and 3. In this embodiment, a support fixture 38 is used to support a deforming member 40, and a deformable body 42 is brought into engagement with deforming member 40, as illustrated in FIG. 2. A force, e.g. an axial force as indicated by arrows 44, is applied to deformable body 42 to pre-work harden deformable body 42 by sufficiently loading deformable body 42 to initiate deformation 46, as illustrated in FIG. 3. In many applications, the load for pre-work hardening should be larger than the load required to expand the deformable body but smaller than the buckle load of the deformable body. Pre-work hardening of deformable body 42 creates a constant resistance as deformable body 42 is continually deformed by deforming member 40 during actuation of well tool 34.

Figure 4:
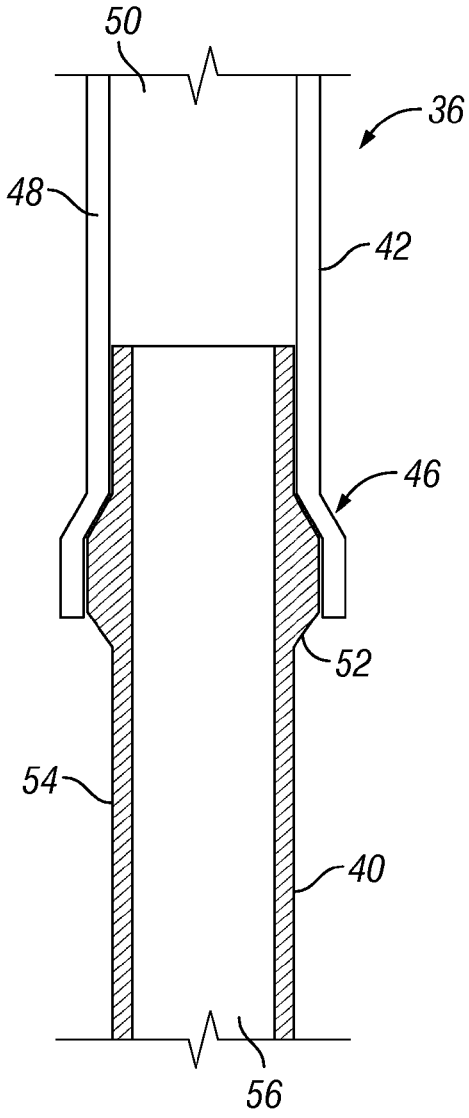
FIG. 4 is a cross-sectional view of one embodiment of the actuation control device ready for deployment in a tool string, according to another embodiment of the present invention.

Following pre-work hardening, resistance device 36 is created by the combination of deformable body 42 and deforming member 40, as illustrated in FIG. 4. The resistance device 36 is ready for installation into well tool string 20 in the preloaded state. In this embodiment, deformable body 42 comprises a sleeve 48 that is generally tubular with a hollow interior 50. Deforming member 40 also is generally tubular and comprises an expander 52 combined with a mandrel 54 having a hollow interior 56. Hollow interiors 50, 56 provide a passageway that can be used for a variety of functions, including passage of fluids and/or routing of control lines, e.g. hydraulic lines, optical fibers, electrical wires and other conductors. It should be noted that one example of resistance device 36 is illustrated in FIG. 4, but the device 36 can be constructed in a variety of forms with a variety of components.

Figure 5:
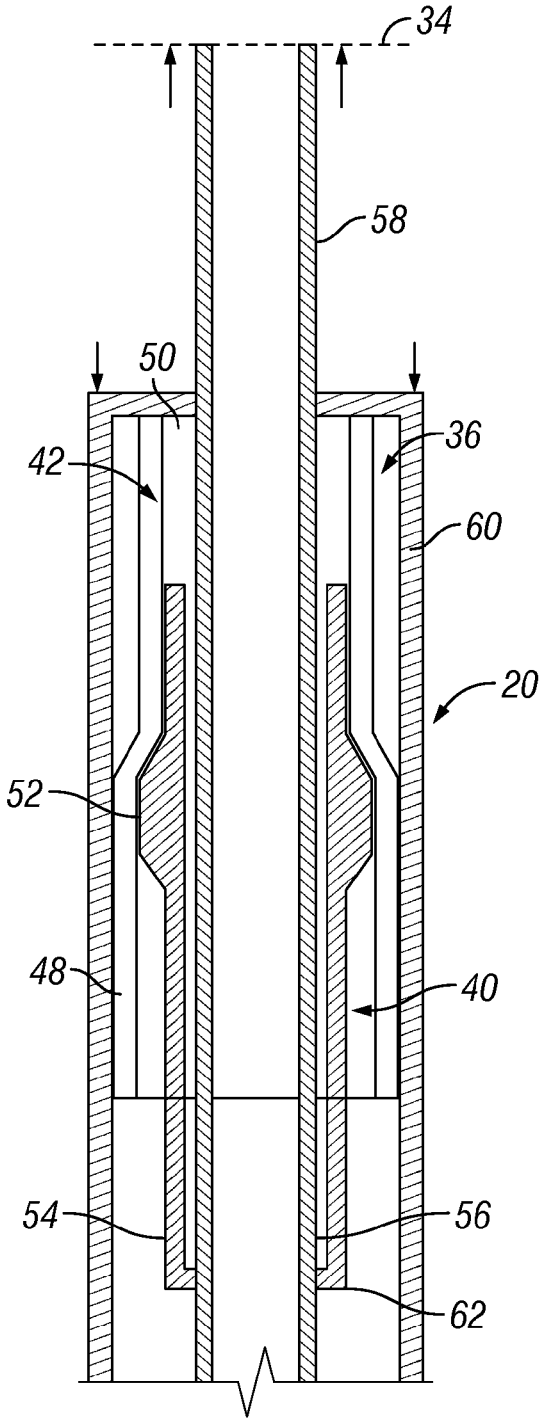
FIG. 5 is a cross-sectional view of one embodiment of the actuation control device coupled into a tool string, according to an embodiment of the present invention.

The resistance device 36 can be connected into well tool string 20 under preload and coupled to actuatable well tool 34 by a suitable attachment member 58, as illustrated in FIG. 5. In this embodiment, well tool 34 is coupled to deforming member 40 via attachment member 58 which is generally in the shape of a hollow tubular. As well tool 34 is actuated, expander 52 of deforming member 40 is pulled along the interior of deformable body 42. The movement of expander 52 deforms deformable body 42 and provides the desired resistance to actuation of well tool 34. In this example, deformable body 42 has been pre-work hardened which ensures a substantially constant resistance to the actuation force applied to well tool 34. The resistance remains substantially constant as expander 52 moves a stroke distance through deformable body 42 required for actuation. The deformable body 42 is held in place in well tool string 20 by an appropriate bracket or connector 60. Furthermore, attachment member 58 may comprise suitable attachment features 62 that cooperate with connector 60 to hold resistance device 36 under a suitable preload prior to actuation of well tool 34.

Figure 6:
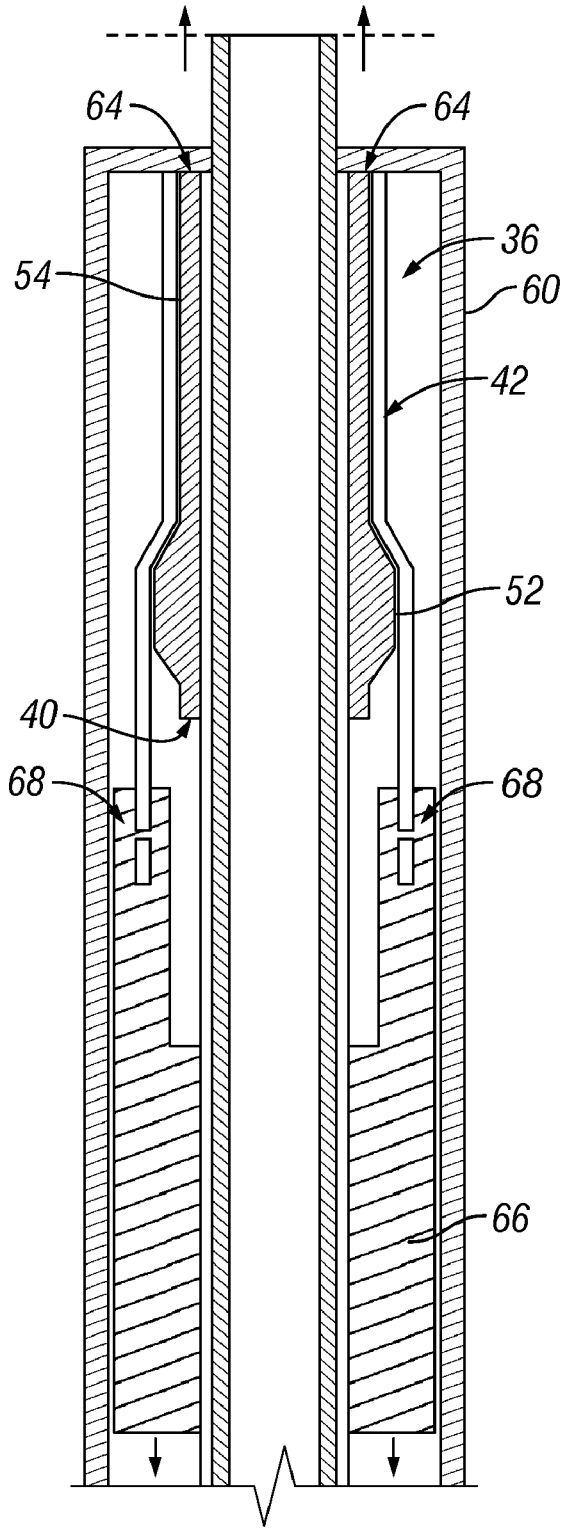
FIG. 6 is a cross-sectional view of an alternate embodiment of the actuation control device coupled into a tool string, according to another embodiment of the present invention.

Another embodiment of resistance device 36 is illustrated in FIG. 6. In this embodiment, deformable body 42 is pulled along deforming member 40. For example, if deformable body 42 is formed as a sleeve, the sleeve is pulled across expander 52. As illustrated, connector 60 is attached to mandrel 54 by an appropriate attachment mechanism 64, and deformable body 42 is connected to a tensile member 66 by appropriate attachment mechanisms 68. As tensile member 66 moves, it draws deformable body 42 across expander 52. In this embodiment, tensile member 66 may be coupled to the actuatable well tool 34.

In other embodiments, resistance device 36 is designed to remain within the elastic limits of deformable body 42 during actuation of well tool 34. This allows resistance device 36 to be used repeatedly for multiple actuations of the well tool. One embodiment of a resistance device 36 that remains within the elastic limits of deformable body 42 is illustrated in FIGS. 7 and 8.

As illustrated, deformable body 42 comprises a sleeve 70 having a plurality of slots 72 separated by bars 74. The slots 72 and bars 74 facilitate or minimize the deformation of the sleeve. In other words, for the same amount of radial expansion, this design experiences less strain than one without slots 72. The design can be used in a manner that plastically deforms bars 74 during use, but the design is amenable to applications where it is desired to maintain deformable member 42 within its elastic limits. The embodiment of FIG. 7 illustrates slots 72 and bars 74 arranged generally parallel and in an axial or longitudinal direction, however other arrangements of slots and bars can be used. The slots 72 are cut or otherwise formed in sleeve 70. Following insertion of deforming member 40 into the interior of sleeve 70, bars 74 are held in place by a cap 76.

Figure 7:
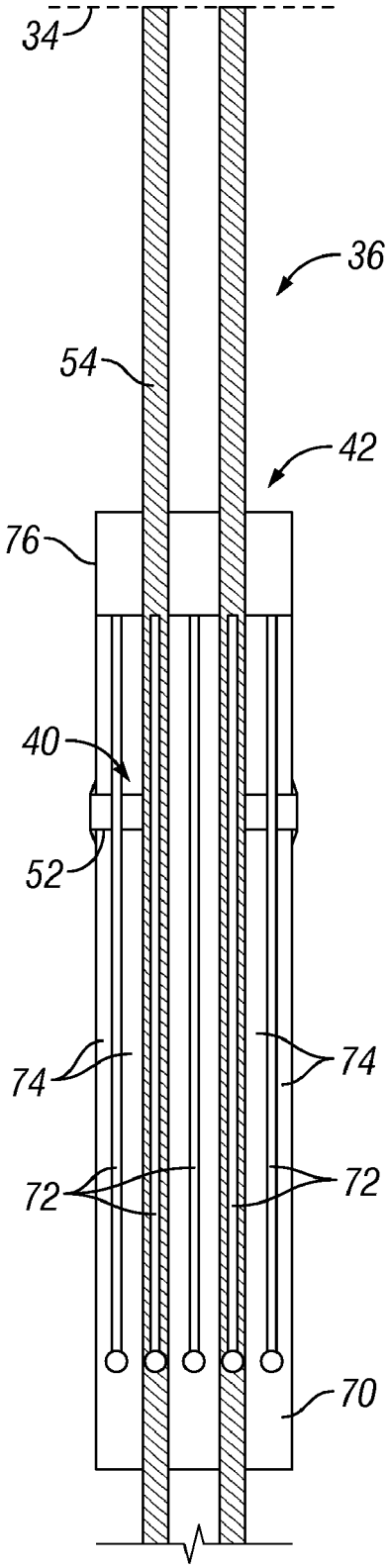
FIG. 7 is a cross-sectional view of an alternate embodiment of the actuation control device coupled into a tool string, according to another embodiment of the present invention.
Figure 8:
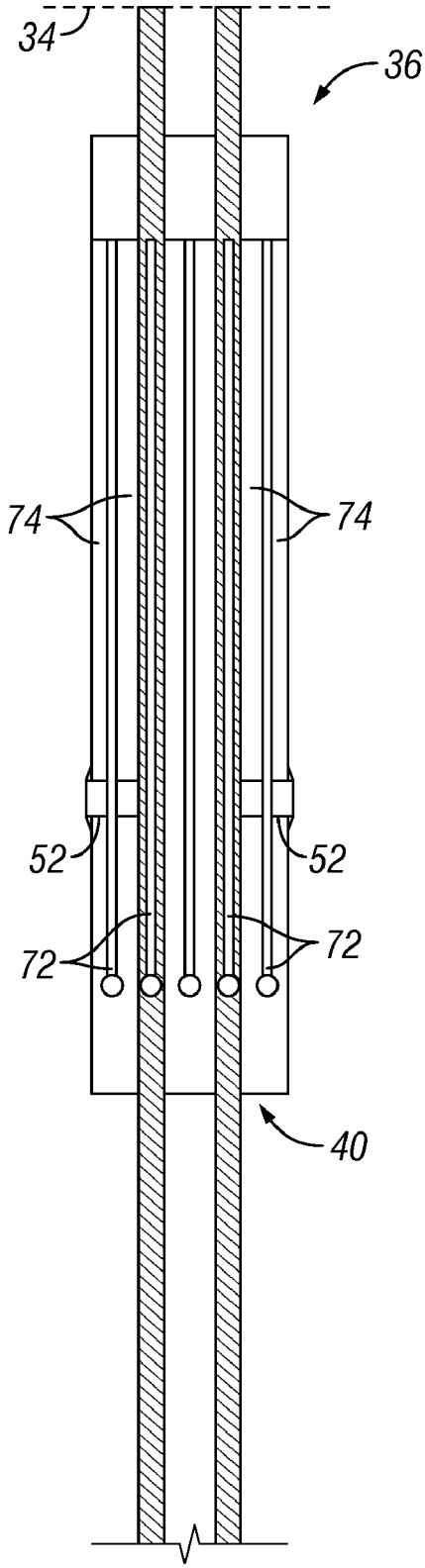
FIG. 8 is a view similar to that of FIG. 7 but with the actuation control device moved to another position, according to another embodiment of the present invention.

In operation, deforming member 40 can be moved back and forth along deformable body 42 to provide a desired resistance multiple times, as illustrated by the different positions of resistance device 36 in FIGS. 7 and 8. In this embodiment, deforming member 40 comprises expander 52 which expands bars 74 outwardly as it moves along sleeve 70, thus providing resistance. However, the outward expansion does not strain bars 74 and deformable member 42 beyond their elastic limits, thus enabling repeated and consistent resistance to movement as deforming member 40 and deformable body 42 are moved relative to each other. To avoid edge of slot effects related to the amount of work required to expand a portion of the sleeve toward the end of the stroke length, slots 72 can be made sufficiently longer than the stroke length, i.e. longer than the relative movement between deforming member 40 and deformable body 42.

Figure 9:
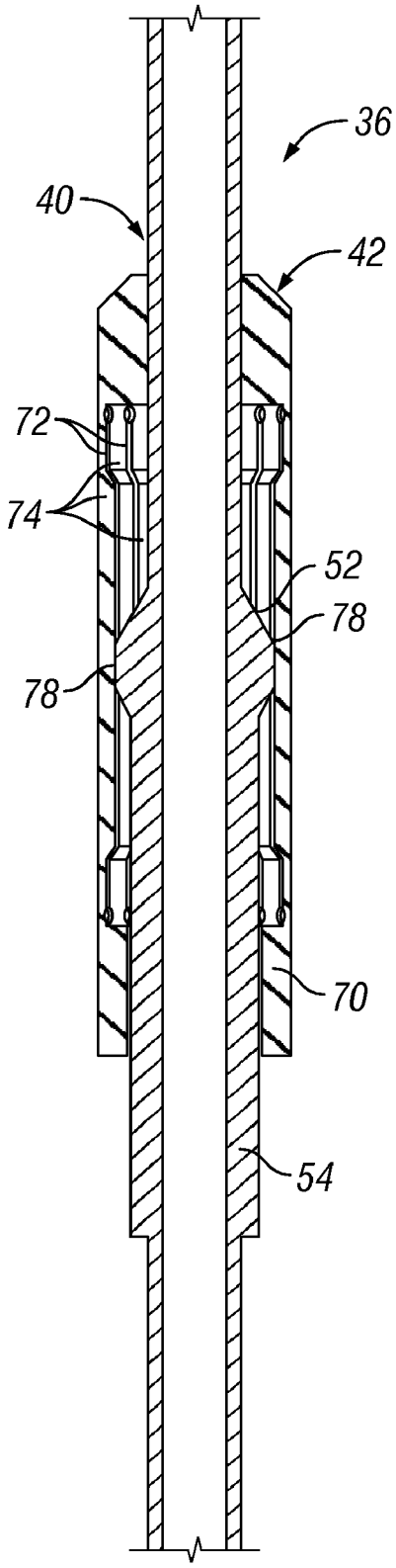
FIG. 9 is a cross-sectional view of an alternate embodiment of the actuation control device, according to another embodiment of the present invention.

In another embodiment, deformable body 42 is again formed as a sleeve 70 with slots 72 arranged in a generally axial direction and closed at both ends, as illustrated in FIG. 9. This type of deformable body 42 also can be designed to undergo elastic radial expansion without incurring plastic deformation. Additionally, deforming member 40 is designed with expander 52 having a friction surface 78. Friction surface 78 may be formed as a roughened surface that creates additional resistive friction force to relative movement of deforming member 40 and deformable body 42. In one embodiment, friction surface 78 is created by a coating applied to the radially outer surface of expander 52 that slidingly engages the interior surface of bars 74.

Figure 10:
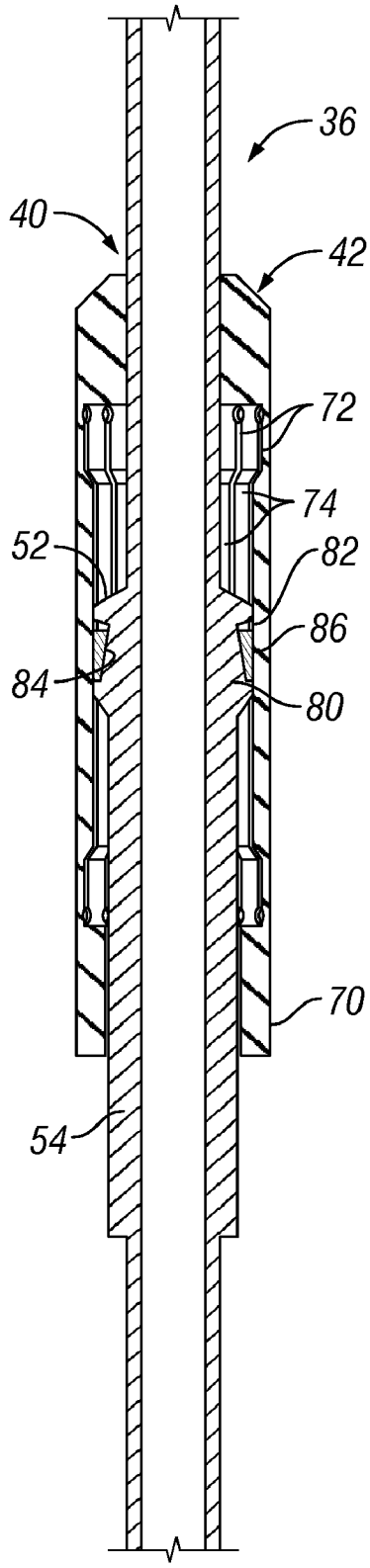
FIG. 10 is a cross-sectional view of an alternate embodiment of the actuation control device, according to another embodiment of the present invention.

Referring generally to FIG. 10, another embodiment of resistance device 36 is illustrated. In this embodiment, deforming member 40 comprises expander 52 constructed with more than one component. For example, expander 52 may comprise a two-piece design having a center support region 80 and a ring 82 movably positioned on center support region 80. The ring 82 is movably mounted on a sloped surface or ramp 84 that slopes in a generally radially outward direction. Accordingly, as deforming member 40 moves in one direction relative to deformable body 42, ring 82 is forced radially outward to resist the force causing relative movement between deforming member 40 and deformable body 42. However, when relative movement between deforming member 40 and deformable body 42 occurs in the opposite direction, ring 82 slides down the ramp to reduce or eliminate the resistance to movement. Accordingly, this embodiment of resistance device 36 resists movement primarily in one direction.

By way of example, ring 82 may be formed as a split ring. Additionally, ring 82 may be provided with a friction coating 86 or other friction inducing surface to further resist movement along deformable body 42. In the embodiment of FIG. 10, resistance device 36 can again be designed such that deformable body 42 remains within its elastic limits as expander 52 moves along its interior. Additionally, deformable body 42 may again be designed with slots 72 separated by bars 74.

The components of resistance device 36 may be constructed in a variety of forms and with a variety of materials. For example, deformable body 42 can be formed from metals, polymers, composite materials, fiber and/or particle reinforced composites, nano tube and/or nano fiber and/or nano particle reinforced composites, or other materials. Additionally, deformable member 42 can be formed as a tubular or sleeve member, as a wall or parallel walls, or as a variety of other shapes designed to undergo deformation when moved relative to deforming member 40. Additionally, deforming member 40 may have a variety of shapes and forms that are able to cooperate with and deform a particular embodiment of deformable body 42. For example, deforming member 40 can be designed to move along an interior or an exterior of the deformable body.

In some embodiments, the material selection and/or the deformable body design can be used to establish a constant resistance. For example, a deformable body 42 as illustrated in FIG. 5 or 6 does not experience work hardening during deformation when constructed from certain materials, such as a fiber reinforced polymer composite material. This material selection effectively renders pre-work hardening of the deformable body 42 unnecessary while still providing a constant resistance over a distance.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of providing a constant resistance in a wellbore, comprising:

coupling a deformable body with a deforming member;

pre-work hardening the deformable body prior to use in the wellbore by applying an axial load to the deformable body by assembling the deformable body and the deforming member into a well tool string under the axial load;

connecting the deformable body and the deforming member to components of the well tool string; and actuating a well component by providing a constant resistance to the actuation of the well component of the well tool string via movement of the deforming member over a distance along the deformable body.

2. The method as recited in claim 1, wherein coupling comprises deploying an expander within a deformable tubular member.

3. The method as recited in claim 1, wherein providing comprises providing a constant resistance to actuation of an inflatable packer.

4. The method as recited in claim 1, wherein providing comprises providing a constant resistance to actuation of a release sub.

5. The method as recited in claim 1, wherein providing comprises providing a constant resistance to actuation of an energy absorber.

6. A system for use in a wellbore, comprising:

a well tool actuated upon application of a sufficient force over a distance; and a resistance device coupled to the well tool to provide a resistance to the force along the distance, the resistance device comprising a deformable body, subjected to pre-work hardening prior to use in the wellbore, and a deforming member positioned to deform the deformable body as the well tool is actuated, wherein the resistance device is coupled to the well tool while preloaded.

7. The system as recited in claim 6, wherein the deformable body comprises a sleeve.

8. The system as recited in claim 7, wherein the deforming member comprises an expander that moves through the sleeve.

9. The system as recited in claim 6, wherein the well tool comprises an inflatable packer.

10. The system as recited in claim 6, wherein the well tool comprises a release sub.

11. The system as recited in claim 6, wherein the well tool comprises an energy absorber.

12. A method of providing a constant resistance in a wellbore, comprising:

coupling a deformable body with a deforming member;

connecting the deformable body and the deforming member to components of a well tool string;

actuating a well component by moving the deforming member along the deformable body by providing a constant resistance to the actuation of the well component of the well tool string; and maintaining deformation of the deformable body within its elastic limits as the deforming member moves along the deformable body.

13. The method as recited in claim 12, further comprising forming the deformable body as a sleeve with a plurality of slots.

14. The method as recited in claim 13, wherein providing comprises providing the constant resistance by moving an expander longitudinally within the sleeve.

15. The method as recited in claim 14, further comprising constructing the expander with a movable ring positioned on a ramp.

16. The method as recited in claim 14, further comprising applying a friction coating to the expander at a location contacting the sleeve.

17. The method as recited in claim 12, further comprising repeatedly providing the constant resistance during a plurality of well component actuations within the wellbore.

18. A system for use in a wellbore, comprising:

a well tool actuated upon application of a sufficient force applied over a distance; and a resistance device coupled to the well tool to provide a constant resistance to the force along the distance, the resistance device comprising a deformable body subjected to pre-work hardening prior to use in the wellbore and a deforming member sized to deform the deformable body within its elastic limits as the well tool is actuated.

19. The system as recited in claim 18, wherein the deformable body comprises a sleeve with a plurality of slots.

20. The system as recited in claim 19, wherein the deforming member comprises an expander that moves longitudinally within the sleeve.

21. The system as recited in claim 20, wherein the expander comprises a movable ring slidably positioned on a ramp.

22. The system as recited in claim 18, wherein the well tool may be repeatedly released and actuated, the resistance device being able to provide the resistance during each actuation.

23. The system as recited in claim 20, wherein the expander comprises a friction coating.

* * * * *